United States Patent [19]

de Méré

[11] 4,044,681

[45] Aug. 30, 1977

[54] CONTROL CIRCUIT FOR THE CONDUCTION OF AN ELECTRONIC SWITCH

[75] Inventor: Henri Edouard Courier de Méré, Paris, France

[73] Assignee: Bicosa Societe de Recherches, Clichy, France

[21] Appl. No.: 631,110

[22] Filed: Nov. 12, 1975

[30] Foreign Application Priority Data

Nov. 14, 1974 France ..... 37623/74

[51] Int. Cl.[2] ..... F42C 11/00

[52] U.S. Cl. ..... 102/70.2 R

[58] Field of Search ..... 102/70.2 R, 19.2; 317/80

[56] References Cited

U.S. PATENT DOCUMENTS

| | | | |
|---|---|---|---|
| 3,548,749 | 12/1970 | Dreitzler | 102/70.2 R |
| 3,598,056 | 8/1971 | West et al. | 102/70.2 R |
| 3,665,860 | 5/1972 | West | 102/19.2 |
| 3,690,259 | 9/1972 | Piazzo et al. | 102/70.2 R |

*Primary Examiner*—Charles T. Jordan

[57] ABSTRACT

A detonator control circuit, principally for use for setting off an explosive charge, but other applications include, e.g., setting off a burglar alarm. The circuit includes a D.C. source, a first thyristor connected in series with the source and a detonator or alarm bell, etc. and a second thyristor connected in a triggering circuit. The control circuit is primed by causing the second thyristor to conduct and thereafter is kept in a state of readiness for allowing the first thyristor to conduct when required and detonate an explosion or ring the bell, etc.

Preferably an indicator lamp shows that priming is taking place successfully and when it goes out the circuit is ready.

11 Claims, 1 Drawing Figure

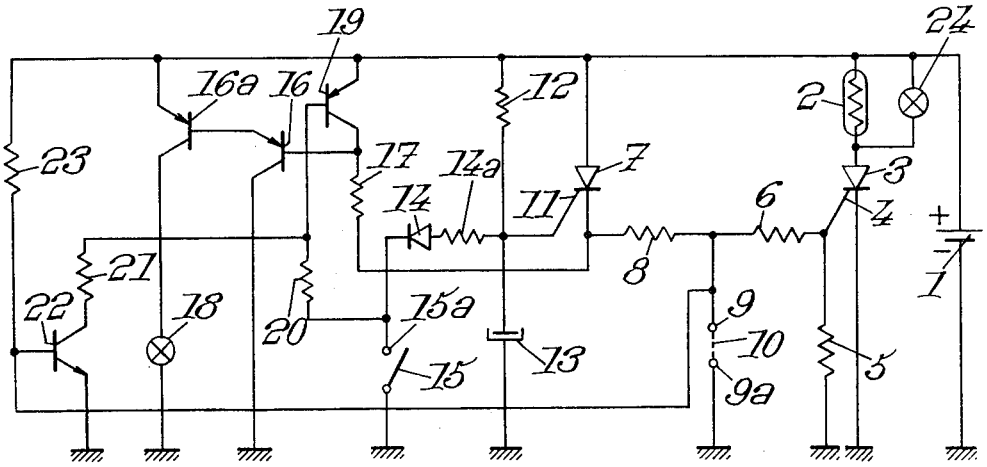
19
24
16a
16
12
2
23
17
14a
7
3
14
11
6
4
+
21
8
1
22
18
20
15a
9
10
13
5
15
9a

CONTROL CIRCUIT FOR THE CONDUCTION OF AN ELECTRONIC SWITCH

The invention concerns a circuit intended for the control of the conductivity of an electronic switch with a control electrode. It concerns more particularly but not exclusively, a detonating circuit intended to cause an electric current to flow through a detonation triggering device, particularly (but not exclusively) for an explosive charge.

There is already known (U.S. Pat. No. 3,665,860) a circuit for detonating an explosive charge which includes a source of direct current, a first electronic switch with a control electrode (thyristor) connected in series with a detonator, a second electronic switch with a control electrode (also a thyristor) and means of tiggering suitable to produce resistance values below a first limit and above a second limit, the first limit being lower than the second. These means of triggering are so arranged that, in operation, they control the conduction of the first electronic switch in such a way that an electric current can flow through said detonator in order to bring about detonation, said second electronic switch being in the feed circuit of the control electrode of the first electronic switch. Finally, this circuit includes means for putting it into a state of readiness. This state of readiness is produced by the charging of a capacitor. When the first electronic switch becomes conducting said capacitor discharges through the detonator thus bringing about the detonation of the explosive charge.

This circuit as described in U.S. Pat. No. 3,665,860 is of complex construction. In addition the charge on a capacitor can only be retained for a limited time. In other words the duration of the state of readiness of the circuit is reduced.

The object of the invention is thus to diminish the above-mentioned disadvantages and thus to produce a circuit of this type intended for the control of the conductivity of a first electronic switch, particularly in order to cause an electric current to flow through a detonator, which is of simple construction, of small bulk, and, above all, capable of maintaining its state of readiness over a long period.

Another object of the invention is to produce a detonating circuit of this type which consumes a negligible quantity of electrical energy during storage in the state of readiness.

The detonating circuit of the type in question, that is with two electronic switches having each a control eletrode, is characterised, according to the invention, in that the source of direct current is connected directly to the terminals of the assembly constituted by the first electronic switch and the detonator arranged in series, in that the means of triggering are also arranged in the feed circuit of the control electrode of the first electronic switch in such a way as to give a conduction signal to the last-mentioned electrode when, on the one hand, the second electronic switch is conducting and, on the other hand, said means of triggering have a resistance value greater than the second limit, and in that said detonation circuit includes means of detonation or of setting it into a state of readiness which supply a signal for conductivity to the control electrode of the second electronic switch in order to render it conducting.

Thus, the setting of the circuit according to the invention in a state of readiness, preferably irreversible, is brought about by making an electronic switch, for example a thyristor, conducting. The maintenance of the conductivity of a thyristor is not, however, limited in time except by discharge of the source of direct current (the battery). This time of maintenance can thus be very long since the current needed to maintain an electronic switch, for example a thyristor, may be very small.

In an embodiment of the invention, the means for setting into a state of readiness include a capacitor, a circuit for charging said capacitor which charges it in a predetermined time and commutation means to prevent at will, by short-circuiting the charging of said capacitor, the latter being arranged to bring about conduction of the second electronic switch once its charge has reached a certain given value.

According to another of its aspects, the invention concerns more generally, a circuit intended for the control of the conduction of a first electronic switch with control electrode, this circuit including a source of direct current, a second electronic switch with control electrode and means of triggering capable of having resistance values less than a first limit or greater than a second limit, the first limit being lower than the second, said means of triggering being arranged in such a way as to control, when in operation, conductivity of the first electronic switch said second electronic switch being in the feed circuit of the control electrode of the first electronic switch. This circuit is characterised, according to the invention, in that said source of direct current is connected to the terminals of the first electronic switch, where necessary via a charge in series, in that the means of triggering are also arranged in the feed circuit of the control electrode of the first electronic switch in such a way as to give a signal controlling conduction to said latter electrode when, on the one hand, the second electronic switch is conducting and, on the other hand, said means of triggering have a resistance greater than the second limit, and in that the control circuit for conduction of the first electronic switch includes means of detonation or to set the device into a state of readiness which supply a signal for conduction to the control electrode of the second electronic switch in order to render it conducting. It is advantageous in this case that the second electronic switch should be a thyristor.

The means of triggering mentioned above may be embodied in various ways. They may consist of a simple conducting wire which, in military applications, breaks when the objective to be destroyed passes. Said means of triggering may also be embodied in the form of a detector of a physical characteristic such as sound or light intensity said detector acting via means with relays to produce a resistance higher than the second limit in the means of triggering. In other applications, particularly civilian, the means of triggering may be radio-controlled.

In the drawings the sole FIGURE is a circuit diagram of a detonation circuit.

As shown in the sole FIGURE the detonation circuit includes, firstly, a source of direct current 1 in the form of a battery, the negative pole of which is earthed. This circuit also includes a wire 2 for detonation of the explosive charge (not illustrated). One terminal of this wire 2 is connected to the positive pole of the source 1 and its other terminal is connected to the anode of a thyristor 3 the cathode of which is earthed.

The gate 4 of the thyristor 3 is earthed via a resistor 5 of 50 KΩ in the example. The gate 4 is also connected to a first terminal of a resistor 6 of 100 KΩ. The second terminal of the resistor 6 is connected, on the one hand, to the cathode of a second thyristor 7 via a resistance 8 of 22 KΩ and, on the other hand, to the first terminal 9 of the means of triggering 10. The second terminal 9*a* of the means of triggering 10 is earthed. The anode of the thyristor 7 is connected to the positive pole of the source 1. The gate 11 of the thyristor 7 is connected to the common point of a resistor 12 of 5 MΩ and a capacitor 13 of 47 μF capacitor. The opposite terminal of the resistor 12 is connected to the positive pole of the source 1 and the opposite terminal of the capacitor 13 is earthed.

The gate 11 of the thyristor 7 is also connected to the anode of a diode 14 via a resistor 14*a.* The cathode of the diode 14 is connected to a terminal 15*a* to which there is connected a switch 15 the other terminal of which is earthed.

The cathode of the thyristor 7 is connected to the base of a PNP transistor 16 via a resistor 17 of 1 MΩ. The collector of the transistor 16 is earthed while the emitter of this transistor is connected to the base of a second PNP transistor 16*a.* The emitter of the transistor 16*a* is connected to the positive terminal of the source 1 and the collector of this transistor is earthed via a signal lamp 18.

The base of the transistor 16 is connected to the collector of a PNP transistor 19 the emitter of which is connected to the positive terminal of the source 1 and the base of which is connected to the first terminal of a 1 MΩ resistor 20. The second terminal of the resistor 20 is connected to the first terminal 15*a* of the switch 15. The base of the transistor 19 is also connnected to the first terminal of a 1 MΩ resistor 21 the second terminal of which is connected to the collector of an NPN transistor 22. The emitter of said transistor 22 is earthed and its base is connected, on the one hand, directly to the terminal 9 of the means of triggering 10 and, on the other hand, to the positive terminal of the source 1 via a 1 MΩ resistor 23.

Finally, a safety signal lamp 24 is arranged in parallel with the wire 2.

In the example the battery 1 is of the type TR 132N marketed by the firm MALLORY, with potential difference 2.7 V and capacity 1 amp.hr, the thyristors 3 and 7 are of the type BRY 55 marketed by the firm SESCOSEM, the maintenance current of these thyristors being of the order of 40 microamperes.

The operation of the detonation circuit just described with reference to the sole FIGURE is as follows:

When the circuit described is not in use, for example when it is in storage, the switch 15 is closed. In this way it is impossible for the capacitor 13 to be charged since the device includes a permanent discharge circuit comprising the resistor 14*a,* the diode 14 and the switch 15; thus the potential of the gate 11 of the thyristor 7 remains close to that of earth and this thyristor 7 remains blocked. In the same conditions (switch 15 closed) the transistor 19 is conducting since its base is earthed via the resistor 20 and said switch 15 and, for this reason, the transistors 16 and 16*a* are blocked. Thus the signal lamp 18 is not lit, that is it emits no visible light.

In the same conditions of storage the triggering means 10 are not connected in the circuit. For simplicity in the example the triggering means are here represented by a simple conducting wire. In any case when the detonating circuit is to be stored for a long period it is preferable that the battery 1 should be disconnected.

When the detonation circuit is set up with the explosive charge in the required position the conducting wire 10 is connected between the terminals 9 and 9*a* with the switch 15 kept closed, the source 1 being connected as shown in the FIGURE.

After the wire 10 of the means of triggering has been connected the switch 15 is opened. If the wire 10 has been connected correctly, the terminal 9 will be at the potential of earth and will thus be the same as that of the base of the transistor 22. This latter transistor will thus be blocked and cannot constitute a shunt between the terminal 15*a* and earth; it is therefore possible for the capacitor 13 to become charged. When the potential of the positive plate of this capacitor 13 has reached a sufficient value substantially equal to that of the positive terminal of the source 1, the thyristor 7 will become conducting and the "state of readiness" is obtained. In fact as long as the wire 10 is connected between the terminals 9 and 9*a* it prevents, by its short-circuiting effect the supply of current to the gate 4 of the thyristor 3. In these conditions the said thyristor 3 remains non-conducting and no current is supplied to the wire 2.

It should be noted that, between the moment at which the switch 15 is opened and the moment at which the thyristor 7 becomes conducting a definite time elapses, which is of the order of three minutes in the example. During this time the installer of the detonating circuit and the explosive charge can move away from the place where the circuit has been installed in complete safety. It will also be noted that, during this period — between the opening of the switch 15 and the onset of conduction in the thyristor 7 — the transistor 19 is blocked since its base is floating — the transistor 22 being itself blocked and the switch 15 open. Thus, the transistors 16 and 16*a* are conducting since the base of the transistor 16 is earthed via the resistors 8 and 17 and the wire 10 and the signal lamp 18 emits visible light. On the other hand, when the thyristor 7 becomes conducting the potential of the base of transistor 16 increases, blocking said transistor and thus the transistor 16*a;* in these conditions the signal light 18 is extinguished, that is it no longer emits visible light.

It should also be remarked that the thyristor 7 and the magnitude of the resistor 8 are so chosen that the current flowing through these elements during the state of readiness is low, that is slightly greater than the maintenance current of the thyristor 7.

If, at the moment when the switch 15 is opened, the conducting wire 10 is wrongly connected, that is in such a way that there is a significant resistance between the terminals 9 and 9*a,* the potential of the base of the transistor 22 will then be greater than the potential of the emitter of the same transistor, which will then be conducting. The terminal 15*a* is then earthed via the resistors 20 and 21 and the collector-emitter path of the transistor 22. The capacitor 13 cannot then become suitably charged since a discharge circuit for this capacitor is in existence. In other words the thyristor 7 cannot be made conducting. In addition, in the same conditions, the transistor 19 is conducting which thus blocks the transistors 16 and 16*a* and prevents the signal lamp from emitting visible light; the operator is thus warned of the incident.

While the conducting wire is being reconnected the switch 15 is closed. Once the conducting wire 10 has been repaired the switch 15 can be opened and, as already stated, in these conditions, the safety period restarts from this moment, the signal light 18 emitting light during this period of safety.

If an incident occurs during the safety period, that is during the time in which the signal lamp 18 is emitting light — the charging of the capacitor 13 can be interrupted by closing the switch 15. In other words the operation of the preliminary period of adjusting to the state of readiness is interrupted. Of course, directly the switch 15 is closed the transistor 19 becomes conducting and, for this reason, the signal lamp 18 is extinguished.

Finally it will be noted that, once the state of readiness has been established — that is once the thyristor 7 is conducting — the position of switch 15 is unimportant, that is this switch 15 can be closed without trouble. It is in fact known that a thyristor remains lit (conducting) even when the pulse applied to its gate in order to render it conducting has been suppressed; for a thyristor to return to its blocked state it is necessary for the current passing through it to reach the value zero.

The state of readiness of the detonation circuit according to the invention is thus irreversible. In addition, as already stated, the consumption of electrical energy by this device during the state of readiness is very low, of the order of 100 microamperes in the example. This device can thus maintain itself in the state of readiness for a considerable period which may be more than a year.

If the resistance between the terminals 9 and 9*a* increases significantly in the example if the wire 10 is broken — the current shunted through the wire 10 is then applied to the control electrode or gate 4 of the thyristor 3 and the latter lights. In this way a significant current can pass through the wire 2 and thus cause explosion of the charge.

The signal lamp 24 makes it possible to detect whether an undesirable current is passing through the wire 2 and to take appropriate safety measures.

The applications of the detonation circuit described above are numerous. For civil applications an element of the type of an electronic switch or relay whose state is controlled from a distance by conventional radio-control devices (not illustrated) is connected between the terminals 9 and 9*a*, the radio-control device being either connected directly by wire or connected through aerials.

In military applications of the detonation circuit according to the invention a device for the detection of the event during which it is desired that the charge should explode may be connected between the terminals 9 and 9*a*. It may consist, as described, of a simple conducting wire installed in a pracitally invisible manner. It may also consist of an electronic switch or relay activated by an acoustic, optical or magnetic detector, or in a general way by a change in an electromagnetic field.

Even although, in the embodiment described, the signal lamps 18 and 24 are used to inform the operator it is, of course, possible to employ other indicating devices.

As is obvious and as has already been seen from the foregoing, the invention is not limited to those modes of application and embodiment which have been more particularly envisaged; it includes, on the contrary, all variants. In particular the detonation circuit according to the invention may be used, in a general way, to supply a signal which requires a significant amount of current; for example the filament 2 may be replaced by an alarm siren for protection against burglary or any other undesirable event.

I claim:

1. Detonation circuit for firing a detonator, comprising a detonator to be fired, a D.C. source, a first electronic switch which includes a control electrode and is connected in series with the detonator and the D.C. source, a feed circuit for the control electrode of the first electronic switch, a second electronic switch, which includes a control electrode, triggering means arranged to offer, in response to detection of an event, an increase in value of resistance from below a first, lower limit to above a second, upper limit, and means for putting the detonation circuit into a state of readiness by giving a conduction signal to the control electrode of the second electronic switch in order to make it conducting wherein the second electronic switch is situated in the feed circuit of the control electrode of the first electronic switch, and the triggering means is situated in series with said second electronic switch, and is adapted to prevent the supply of current from said second electronic switch to the control electrode of said first electronic switch when said second electronic switch is conducting and said triggering means has a value of resistance less than that of said lower limit, said second electronic switch being adapted to provide a control signal to the control electrode of the first electronic switch, when the second electronic switch is conducting and the triggering means has a resistance above the second limit, to render said control electrode of the first electronic switch conductive.

2. Detonation circuit of claim 1, wherein said triggering means includes a conducting wire and the detected event which results in the increase in the value of resistance is breaking of the wire.

3. Detonation circuit for firing a detonator, comprising a detonator to be fired, a D.C. source, a first electronic switch which includes a control electrode and is connected in series with the detonator and the D.C. source, a feed circuit for the control electrode of the first electronic switch, a second electronic switch which includes a control electrode, triggering means arranged to offer, in response to detection of an event, an increase in value of resistance from below a first, lower limit to above a second, upper limit, said triggering means being arranged, in operation, to control conduction of the first electronic switch so that an electric current is able to flow through the detonator, the second electronic switch being situated in the feed circuit of the control electrode of the first electronic switch, wherein the triggering means are situated in the feed circuit of the control electrode of the first electronic switch to give a signal controlling conduction to the first switch control electrode when the second electronic switch is conduction and the triggering means has a resistance above the second limit, and means for putting the detonation circuit into a state of readiness including a capacitor, a charging circuit for said capacitor to charge it in a predetermined time, and manually operable commutating means for selectively preventing the charging of the capacitor by short-circuiting, said capacitor being arranged to cause conductivity of said second electronic switch as soon as its charge has reached a certain value.

4. Detonation circuit according to claim 3, including means for inhibiting, by short-circuiting, charging of the capacitor when the triggering means has a resistance at least equal to the second, upper limit and during the period previous to application of a signal for conductivity to the control electrode of the second electronic switch.

5. Detonation circuit according to claim 4, wherein the means for inhibiting includes electronic switching means with a control electrode, such as a transistor, the control electrode of said switching means being capable of receiving a signal representing the value of the resistance of the triggering means.

6. Detonation circuit according to claim 3, including signalling means arranged to emit an indicating signal with a first value during charging of said capacitor, said signal having a second value when the second electronic switch is conducting or when the triggering means has a resistance at least equal to the second, upper limit, the second electronic switch not then being in the conducting state.

7. Detonation circuit according to claim 5, wherein said electronic switching means of said inhibiting means in a transistor.

8. A control circuit intended to control conduction of a first electronic switch having a control electrode, the control circuit comprising a D.C. source, a feed circuit for the control electrode of said first electronic switch, a second electronic switch having a control electrode, triggering means arranged to offer, in response to detection of an event, an increase in value of resistance from below a first, lower limit, to above a second, upper limit, and means in the control circuit for putting the control circuit into a state of readiness by giving a signal for conductivity to the control electrode of the second electronic switch so as to render it conducting wherein the second electronic switch is situated in the feed circuit of the control electrode of the first electronic switch, and the triggering means is situated in series with said second electronic switch, and is adapted to prevent the supply of current from said second electronic switch to the control electrode of said first electronic switch when said second electronic switch is conducting and said triggering means has a value of resistance less than that of said lower limit, said second electronic switch being adapted to provide a control signal to the control electrode of the first electronic switch, when the second electronic switch is conducting and the triggering means has a resistance above the second limit, to render said control electrode of the first electronic switch conductive.

9. Circuit according to claim 8, wherein said means for putting the circuit into a state of readiness includes a capacitor, a charging circuit for said capacitor to charge it in a given time, and switching means to prevent, at will, by short-circuiting, the charging of said capacitor, said capacitor being arranged to cause conduction of said second electronic switch as soon as its charge has reached a given value.

10. Circuit according to claim 8, wherein the second electronic switch is a thyristor.

11. A control circuit intended to control conduction of a first electronic switch having a control electrode, the control circuit comprising a D.C. source, a feed circuit for said control electrode, a second electronic switch having a control electrode, a triggering means arranged to offer, in response to detection of an event, an increase in value of resistance values from below a first, lower limit, to above a second, upper limit, said triggering means being arranged, when in operation, to control conduction of the first electronic switch, said second electronic switch being situated in the feed circuit of the control electrode of the first electronic switch, said D.C. source being connected to the terminals of the first electronic switch, where necessary via a series charge, and the triggering means being arranged in the feed circuit of the control electrode of the first electronic switch in such a way as to give a signal for conduction to said control electrode of said first electronic switch when, on the one hand, the second electronic switch is conducting and, on the other hand, when said triggering means offers a resistance above the second limit, and means in control circuit for putting the control circuit into a state of readiness including a capacitor, a charging circuit for said capacitor to charge it in a given time, and switching means to prevent, at will, by short-circuiting, the charging of said capacitor, said capacitor being arranged to cause conduction of said second electronic switch as soon as the charge of said capacitor has reached a given value.

* * * * *

UNITED STATES PATENT AND TRADEMARK OFFICE

CERTIFICATE OF CORRECTION

PATENT NO. : 4,044,681

DATED : August 30, 1977

INVENTOR(S) : Henri Edouard Courier de Mere

It is certified that error appears in the above-identified patent and that said Letters Patent are hereby corrected as shown below:

Column 6, line 55 - "conduction" should be -- conducting --

Column 7, line 20 - "in a transistor" should be -- is a transistor --

Column 8, line 36 - after "means in" insert -- the --

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*